US006945062B2

(12) United States Patent
Chen et al.

(10) Patent No.: US 6,945,062 B2
(45) Date of Patent: Sep. 20, 2005

(54) HEAT PUMP WATER HEATING SYSTEM INCLUDING A COMPRESSOR HAVING A VARIABLE CLEARANCE VOLUME

(75) Inventors: Yu Chen, East Hartford, CT (US); Lili Zhang, East Hartford, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/728,354

(22) Filed: Dec. 4, 2003

(65) Prior Publication Data

US 2005/0120730 A1 Jun. 9, 2005

(51) Int. Cl.[7] ..... F25B 49/00
(52) U.S. Cl. ..... 62/228.5; 417/274
(58) Field of Search ..... 62/228.5, 238.1, 62/238.6, 238.7, 226, 324.6; 417/274; 92/60.5

(56) References Cited

U.S. PATENT DOCUMENTS

| | | | | |
|---|---|---|---|---|
| 3,004,810 | A * | 10/1961 | King | 92/84 |
| 3,908,373 | A * | 9/1975 | Peterson | 60/371 |
| 3,951,569 | A * | 4/1976 | Jacobs | 417/269 |
| 3,986,664 | A * | 10/1976 | Gustafsson | 237/2 B |
| 3,998,570 | A * | 12/1976 | Jacobs | 417/274 |
| 4,008,006 | A * | 2/1977 | Bea | 417/271 |
| 4,024,704 | A * | 5/1977 | Hudson | 60/39.25 |
| 4,145,163 | A * | 3/1979 | Fogelberg et al. | 417/222.1 |
| 4,630,447 | A * | 12/1986 | Webber | 60/712 |
| 4,694,732 | A * | 9/1987 | Kursar | 92/60.5 |
| 5,141,413 | A | 8/1992 | Bennitt | |
| 5,378,116 | A * | 1/1995 | Bennitt et al. | 417/296 |
| 5,520,015 | A * | 5/1996 | Lukas et al. | 62/506 |
| 5,622,486 | A * | 4/1997 | McDuffie et al. | 417/536 |
| 5,735,675 | A * | 4/1998 | Peoples et al. | 417/275 |
| 6,233,958 | B1 * | 5/2001 | Mei et al. | 62/238.7 |
| 6,257,838 | B1 * | 7/2001 | Schlossarczyk et al. | 417/280 |
| 6,318,967 | B1 * | 11/2001 | Wirz et al. | 417/53 |
| 6,397,892 | B1 * | 6/2002 | Pyle et al. | 137/637.2 |
| 6,523,359 | B1 * | 2/2003 | Posch | 62/173 |
| 6,629,488 | B2 * | 10/2003 | Hugelman | 92/12.2 |
| 6,663,358 | B2 * | 12/2003 | Loprete et al. | 417/313 |
| 6,823,683 | B2 * | 11/2004 | Amaral et al. | 62/159 |

FOREIGN PATENT DOCUMENTS

JP 361034383 * 2/1986

* cited by examiner

*Primary Examiner*—Harry B. Tanner
*Assistant Examiner*—Mohammad M. Ali
(74) *Attorney, Agent, or Firm*—Carlson, Gaskey & Olds

(57) ABSTRACT

A heat pump water heater system includes a compressor that has a variable clearance volume that can be selectively controlled to control the mass flow rate of refrigerant from the compressor. Under higher ambient air temperature conditions, the variable volume is increased to keep refrigerant in a variable clearance volume chamber and to decrease the mass flow rate of the refrigerant from the compressor. Under lower ambient air temperature conditions the variable volume is decreased to increase the mass flow rate. The variable clearance volume allows for maintaining optimum system performance under a variety of ambient air temperature conditions.

23 Claims, 1 Drawing Sheet

HEAT PUMP WATER HEATING SYSTEM INCLUDING A COMPRESSOR HAVING A VARIABLE CLEARANCE VOLUME

FIELD OF THE INVENTION

This invention generally relates to heat pump water heaters. More particularly, this invention relates to optimizing the performance of a heat pump water heater by varying a clearance volume of a compressor.

DESCRIPTION OF THE RELATED ART

Vapor compression heat pumps used as water heaters are known. More recently, carbon dioxide has been considered as a working fluid within the system that includes a compressor, a gas cooler heat exchanger, an expansion device and an evaporator heat exchanger. In a heat pump water heating system that uses carbon dioxide as the refrigerant fluid, super critical carbon dioxide rejects heat in the gas cooler to water that is then stored in a water heater tank.

Such systems have a wide range of operating conditions. The ambient air temperature at the evaporator heat exchanger inlet may vary between −10° F. in winter to 120° F. in summer, for example. Correspondingly, the refrigerant evaporating temperature changes approximately from between −25° F. to 100° F. As a result, the mass flow rate of the refrigerant in the summer can be on the order of eight to ten times higher than that in winter. The heating capacity can also be four to five times higher in the summer compared to that in the winter.

The gas cooler and evaporator heat exchangers are designed to handle the changing refrigerant flow rates and heating capacities but they are optimized for the seasonal average condition, which may be 50° F., for example. The performance of the gas cooler and evaporator heat exchangers is highly dependent on the mass flow rate of the refrigerant. Accordingly, these components do not have an optimal performance during ambient temperature conditions that vary from the selected design average temperature.

There is a need for optimizing the capacity of a heat pump water heating system to achieve the best performance over a wide variety of operating ambient temperatures. This invention addresses that need by incorporating a variable clearance volume as part of a compressor that can be selectively controlled to control the mass flow rate of the refrigerant within the system.

SUMMARY OF THE INVENTION

In one example, a compressor designed for use in a heat pump water heating system includes a compression cylinder in fluid communication with a suction port and a discharge port of the compressor. A clearance volume portion is also in fluid communication with the compression cylinder. The clearance volume portion provides a selectively variable volume to receive refrigerant from the compression cylinder to control the mass flow rate of refrigerant out of the compression cylinder through the compressor discharge port.

In one example, the clearance volume portion includes at least one moveable member within a clearance chamber that is moveable between a maximum and minimum position to selectively vary the volume available for receiving refrigerant from the compression cylinder.

In one example, a controller utilizes information regarding the ambient temperature near the system and selectively controls the position of the moveable member such that the flow rate of refrigerant through the compressor discharge port optimizes the performance of the heat pump system for the determined ambient temperature condition.

One example method includes determining an ambient temperature in the vicinity of a heat pump water heater system and selectively altering the mass flow rate of refrigerant from a compressor in the system responsive to changes in the ambient temperature.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
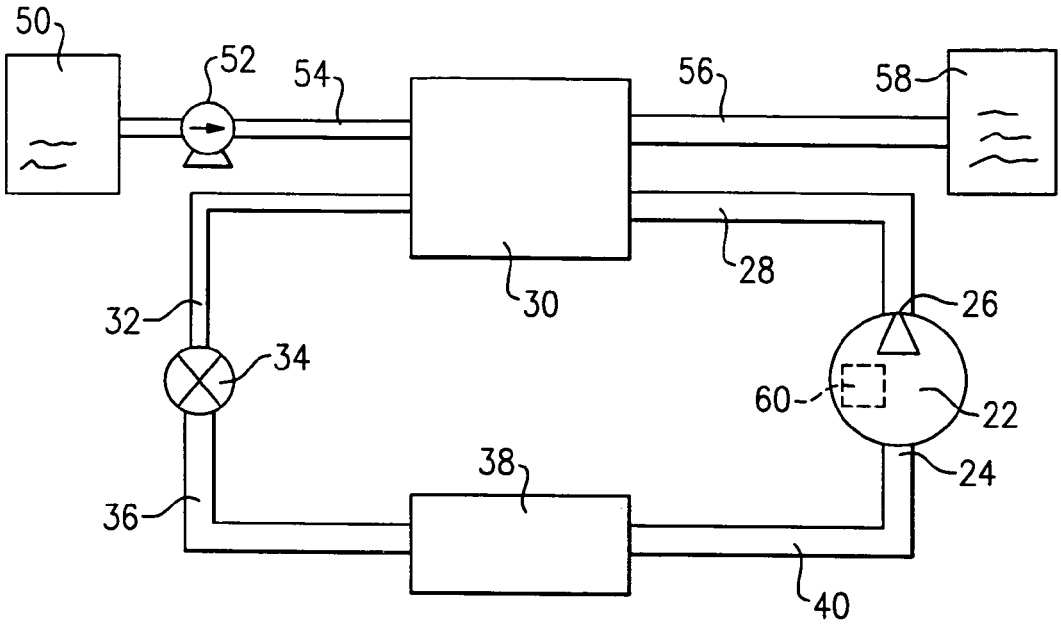
FIG. 1 schematically illustrates a heat pump water heating system designed according to an embodiment of this invention.

FIG. 1 schematically illustrates an example vapor compression system 20 that can be used as a heat pump water heater system. The example system includes a compressor 22 that draws refrigerant into a suction port 24 and provides compressed gas under pressure to the compressor discharge port 26. The high temperature, pressurized gas flows through a conduit 28 to a gas cooler 30 where the gas dissipates heat. The cooled refrigerant flows through a conduit 32 to an expansion device 34.

In one example, the expansion device 34 operates in a known manner to allow the cooled refrigerant to be expanded and to partially evaporate and flow into a conduit 36 in the form of a cold, low pressure refrigerant. This refrigerant then flows through an evaporator where the refrigerant absorbs heat from ambient air that flows across the evaporator coils in a known manner. The refrigerant exiting the evaporator 38 flows through a conduit 40 to the suction portion 24 of the compressor 22 where the cycle continues.

In the example of FIG. 1, the system 20 is used as a heat pump water heater. A supply of water 50 is directed by a pump 52 through a conduit 54 toward the gas cooler 30. Although not specifically illustrated, water in the conduit 54 flows through the gas cooler 30 and absorbs heat from the refrigerant flowing through the gas cooler 30. Heated water flows through a conduit 56 after exiting the gas cooler 30 and is stored in a heated water tank 58 that operates in a known manner.

During high ambient temperature conditions, such as during the summer, the temperature of the ambient air is greater than the seasonal average condition. This increased ambient temperature increases the evaporating pressure and the refrigerant mass flow rate in the system 20. As a result, the temperature of the refrigerant exiting the gas cooler and the approach temperature, which is the temperature difference between the temperature of the refrigerant exiting the gas cooler 30 and the temperature of the water entering the gas cooler 30 in the conduit 54, increase. The temperature of the refrigerant exiting the gas cooler 30 and the gas cooler effectiveness affect the efficiency of the heat pump system 20. Therefore, during high ambient temperature conditions, the performance of the gas cooler and the system generally decreases.

The disclosed example embodiment of this invention addresses such a situation by increasing a variable clearance volume 60 in the compressor 22 to selectively decrease the mass flow rate of refrigerant in the system. This does not introduce any loss at the compressor. In other words, the disclosed approach is a loss-free control for optimizing system performance under a variety of ambient temperature conditions.

By decreasing the mass flow rate, the refrigerant passes through the gas cooler 30 more slowly, which increases the energy exchange per unit mass of the refrigerant in the gas cooler. This increases the performance of the gas cooler. It must be noted, however, that as the mass flow rate is reduced, the fan power per unit mass of the refrigerant increases. Therefore, an optimal volume of the variable clearance volume 60 in the compressor 22 and a corresponding optimal mass flow rate of the refrigerant will achieve the best system performance for various environmental conditions.

With this invention, the heat exchangers of the gas cooler 30 and evaporator 38 can be made smaller since the refrigerant mass flow rate at higher ambient temperature conditions can be decreased by controlling the clearance volume 60 within the compressor. This provides cost savings because the parts are smaller and need not withstand such high pressure as in previous systems.

Figure 2:
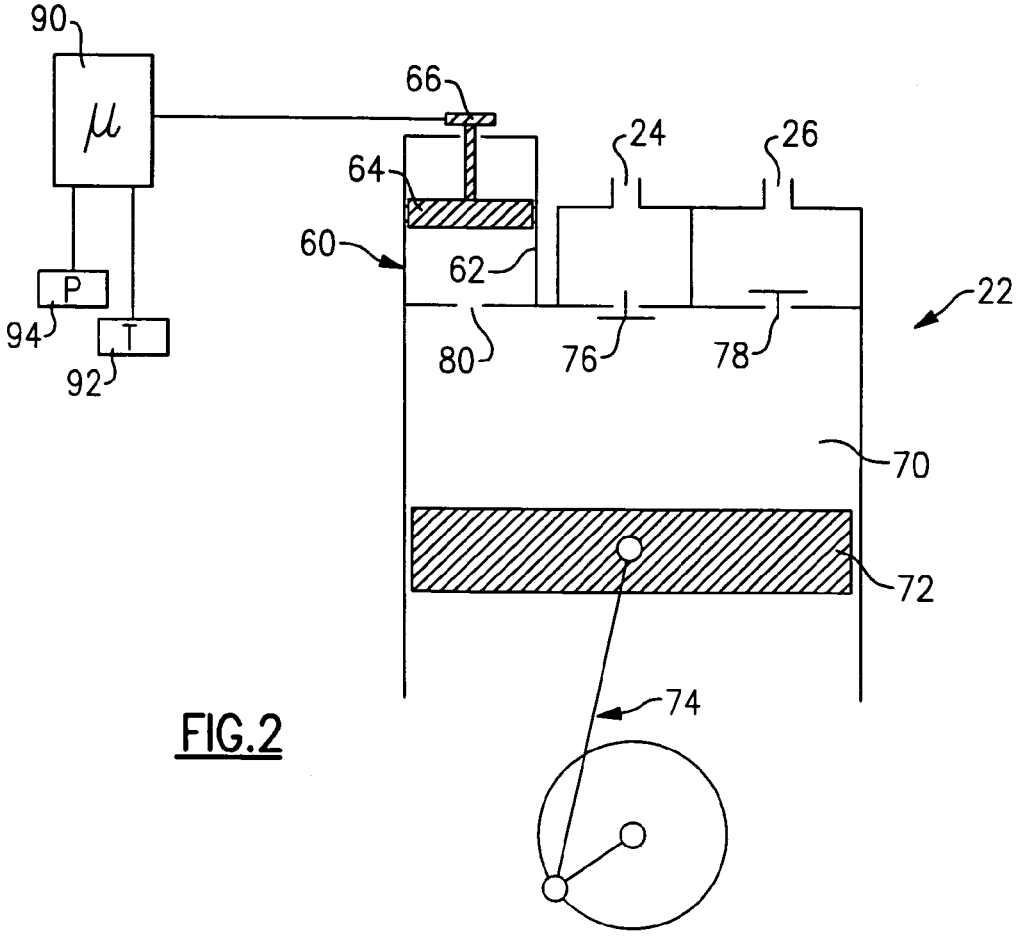
FIG. 2 schematically illustrates selected portions of the embodiment of FIG. 1 showing schematic details of an example compressor designed according to an embodiment of this invention.

FIG. 2 schematically illustrates an example compressor arrangement that is useful with the embodiment of FIG. 1, for example. The variable clearance volume 60 in this example includes a clearance chamber 62 and a moveable wall portion 64 within the chamber. The position of the wall portion 64 within the chamber 62 defines the volume of the chamber 62 to selectively control the amount of refrigerant that can be maintained within the chamber 62. In the illustrated example, an actuator 66 is capable of moving the wall portion 64 between a maximum position corresponding to a maximum volume within the chamber 62 and a minimum position corresponding to a minimum volume within the chamber 62. In one example, the minimum position corresponds to having the chamber 62 completely sealed off from receiving or maintaining any refrigerant (i.e., a zero volume). In one example, the actuator 66 comprises a solenoid. Other known devices for moving the wall portion 64 in a manner that will hold the wall portion in a desired position to withstand the pressures within the compressor 22 are known and within the scope of this invention. Given this description, the skilled artisan will be able to select components to meet their particular needs.

The example compressor 22 is a reciprocating compressor having a compression cylinder 70 within which a piston 72 moves in a reciprocating manner. A conventional crank shaft arrangement 74 is responsible for movement of the piston 72. Refrigerant is drawn in through the suction port 24 by controlling a suction valve 76 in a known manner. Movement of the piston 72 within the compression cylinder pressurizes the gas within the compression cylinder 70 until it is discharged by controlling a discharge valve 78 associated with the discharge port 26 in a known manner.

The variable clearance volume 60 is in fluid communication with the compression cylinder 70 through a port 80.

The illustrated example includes a controller 90 in communication with a plurality of sensors for determining operating conditions associated with the system 20. In the illustrated example, a temperature sensor 92 and a pressure sensor 94 provide information to the controller 90 regarding an ambient temperature in the vicinity of portions of the system 20 and refrigerant pressure within selected portions of the system 20, respectively, for example.

In one example, the controller 90 utilizes ambient temperature information within the vicinity of the system 20. In one example the controller 90 determines the temperature of the air that is used in the evaporator 38. As the ambient temperature changes, the controller 90 preferably controls the actuator 66 associated with the wall portion 64 to selectively vary the clearance volume 60 within the chamber 62. This allows for a variable amount of refrigerant to be kept within the chamber 62 during operation of the compressor 22. For example, as the piston 72 moves in a direction forcing compressed fluid out of the compression cylinder (upward according to the drawing), some of the fluid will be maintained within the clearance chamber 62 even though the discharge valve 78 is open to allow the fluid to flow out of the discharge port 26.

Depending on the operating conditions of the system, such as the ambient temperature, the controller 90 controls the actuator 66 to control the position of the wall portion 64 within the chamber 62. For higher ambient temperatures, the system coefficient of performance can be maximized by reducing the mass flow rate of the refrigerant. Accordingly, the clearance volume is increased by the controller 90 and the actuator 66. During lower ambient temperature conditions, the clearance volume can be reduced, minimized or completely eliminated to maximize the heating capacity of the system in one example, the controller 90 determines a pressure within the system 20 and uses the information when varying the clearance volume. Given this description, those skilled in the art will be able to select appropriate temperature ranges and corresponding volumes of the variable clearance volume 60 to meet the needs of their particular situation.

In one example, the controller 90 also controls the fan rate of the fan associated with the evaporator 38 along with controlling the variable volume 60 to achieve an optimum coefficient of performance for the system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A compressor, comprising:

a compression cylinder adapted to receive fluid from a suction port and to urge the fluid out of a discharge port;

a moveable member within the compression cylinder for compressing the fluid within the cylinder and urging it out of the discharge port; and a variable clearance volume chamber in fluid communication with the compression cylinder, the chamber having a selectively variable volume for containing a correspondingly variable amount of the fluid for decreasing a mass flow rate of the compressor as an ambient temperature increases.

2. The compressor of claim 1, wherein the variable clearance volume chamber includes a moveable wall portion that is selectively moveable between a maximum volume position and a minimum volume position.

3. The compressor of claim 1, wherein the moveable member comprises a piston that reciprocates within the compression cylinder and wherein the variable clearance volume chamber is positioned to receive fluid from the compression cylinder as the piston moves in a direction to urge the fluid out of the discharge port.

4. The compressor of claim 1, including a controller that selectively controls the volume of the variable clearance volume chamber.

5. The compressor of claim 4, wherein the controller determines an ambient air temperature and responsively controls the volume.

6. A water heater system, comprising:

a gas cooler having a heat exchanger that facilitates transferring heat between a refrigerant and water; a tank for receiving water heated by the transferred heat;

an evaporator having a heat exchanger that facilitates transferring heat between ambient air and the refrigerant;

an expansion device between the gas cooler and the evaporator; and a compressor that draws the refrigerant from the evaporator, pressurizes the refrigerant and directs the refrigerant to the gas cooler, the compressor including a variable clearance volume for selectively controlling a mass flow rate of the refrigerant.

7. The system of claim 6, including a controller that selectively controls the volume of the variable clearance volume.

8. The system of claim 7, wherein the controller determines an ambient air temperature and responsively controls the volume.

9. The system of claim 8, wherein the controller controls the size of the variable clearance volume to change the mass flow rate of the refrigerant to maximize the system performance.

10. The system of claim 6, wherein the variable clearance volume includes a moveable wall portion that is selectively moveable between a maximum volume position and a minimum volume position.

11. The system of claim 6, wherein the compressor comprises a piston that reciprocates within a compression cylinder and wherein the variable clearance volume is positioned to receive the refrigerant from the compression cylinder as the piston moves in a direction to direct the refrigerant to the gas cooler.

12. The system of claim 7, wherein the controller determines a temperature associated with the evaporator and controls the variable volume within the compressor responsive to the determined temperature.

13. The system of claim 7, wherein the controller determines a pressure within the system and controls the variable volume within the compressor responsive to the determined pressure.

14. The system of claim 7, wherein the controller controls a fan associated with the evaporator in a manner corresponding to the control of the variable volume.

15. A method of controlling refrigerant flow in a water heater system, comprising:

selectively varying a clearance volume in a compressor responsive to an ambient air temperature condition including at least one of decreasing the clearance volume responsive to a decreasing ambient temperature condition; or increasing the clearance volume respective to an increasing ambient temperature condition.

16. The method of claim 15, including decreasing the size of the clearance volume to a level to maximize the system performance.

17. The method of claim 15, including increasing the clearance volume responsive to an increasing ambient air temperature condition.

18. The method of claim 15, including increasing the size of the clearance volume to a level to maximize the system performance.

19. A method of controlling refrigerant flow in a water heater system, comprising:

selectively varying a clearance volume in a compressor responsive to an ambient air temperature condition including decreasing a mass flow rate of the compressor as the ambient air temperature increases.

20. A compressor, comprising:

a compression cylinder adapted to receive fluid from a suction port and to urge the fluid out of a discharge port;

a moveable member within the compression cylinder for compressing the fluid within the cylinder and urging it out of the discharge port;

a variable clearance volume chamber in fluid communication with the compression cylinder, the chamber having a selectively variable volume for containing a correspondingly variable amount of the fluid; and an electronic controller that determines at least one condition associated with the compressor and selectively controls the volume of the variable clearance volume chamber responsive to the determined condition.

21. The compressor of claim 20, wherein the controller determines a pressure and responsively controls the variable volume.

22. The compressor of claim 20, wherein the controller determines an ambient air temperature and responsively controls the volume in the compressor.

23. A compressor, comprising:

a compression chamber adapted to receive fluid from a suction portion and to urge the fluid out of a discharge port;

a moveable member within the compression chamber for compressing the fluid within the chamber and urging it out of the discharge port; and a variable clearance volume chamber in communication with the compression chamber, the variable clearance volume chamber having a selectively variable volume for retaining a corresponding amount of fluid that increases as an ambient temperature increases.

* * * * *